US008522858B2

(12) United States Patent
Plociennik et al.

(10) Patent No.: US 8,522,858 B2
(45) Date of Patent: Sep. 3, 2013

(54) METHOD AND APPARATUS FOR CONTINUOUS CASTING

(75) Inventors: Uwe Plociennik, Ratingen (DE); Jens Kempken, Kaarst (DE); Peter Jonen, Duisburg (DE); Ingo Schuster, Willich (DE); Tilmann Böcher, Düsseldorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/353,511

(22) Filed: Jan. 19, 2012

(65) Prior Publication Data

US 2012/0111527 A1 May 10, 2012

Related U.S. Application Data

(62) Division of application No. 12/087,305, filed as application No. PCT/EP2006/012560 on Dec. 28, 2006.

(30) Foreign Application Priority Data

Jan. 11, 2006 (DE) ..... 10 2006 001 464
Nov. 30, 2006 (DE) ..... 10 2006 056 683

(51) Int. Cl.
*B22D 11/124* (2006.01)

(52) U.S. Cl.
USPC ..... 164/444; 164/486; 164/455

(58) Field of Classification Search
USPC ..... 164/443, 444, 455, 485–487
See application file for complete search history.

(56) References Cited

U.S. PATENT DOCUMENTS

| | | | | |
|---|---|---|---|---|
| 3,358,358 | A | 12/1967 | Jenks et al. | |
| 3,897,906 | A | 8/1975 | Bachner | |
| 3,981,347 | A * | 9/1976 | Willim | 164/486 |
| 5,810,069 | A | 9/1998 | Flick et al. | |

(Continued)

FOREIGN PATENT DOCUMENTS

| | | |
|---|---|---|
| AT | 323921 | 8/1975 |
| DE | 2208928 Y | 7/1973 |

(Continued)

OTHER PUBLICATIONS

JPO machine translation of JP 08267205 A, Oct. 15, 1996.*

(Continued)

*Primary Examiner* — Kevin P Kerns
*Assistant Examiner* — Kevin E Yoon
(74) *Attorney, Agent, or Firm* — Lucas & Mercanti, LLP; Klaus P. Stoffel

(57) ABSTRACT

A method for continuous casting from molten metal, where metal flows vertically downward from a mold and metal strip is then guided vertically downward along a vertical strand guide, cooling as it moves. The strip is deflected from the vertical direction to the horizontal direction. In the terminal area of the deflection of the strip into the horizontal direction or after the deflection into the horizontal direction, a mechanical deformation of the strip is carried out. The strip is cooled at a heat-transfer coefficient of 3,000 to 10,000 W/(m$^2$ K) in a first section downstream of the mold and upstream of mechanical deformation of the strip. In a second section, downstream of the cooling, the strip surface is heated to a temperature above Ac3 or Ar3 by heat equalization in the strip. The mechanical deformation is subsequently carried out in a third section.

4 Claims, 3 Drawing Sheets

(56) References Cited

U.S. PATENT DOCUMENTS

| | | | |
|---|---|---|---|
| 6,374,901 | B1 | 4/2002 | Frank et al. |
| 6,880,616 | B1 | 4/2005 | Kemna et al. |
| 2002/0129921 | A1 | 9/2002 | Frank et al. |

FOREIGN PATENT DOCUMENTS

| | | | | |
|---|---|---|---|---|
| DE | 2435495 | Y | | 2/1975 |
| DE | 2507971 | Y | | 9/1975 |
| DE | 2631564 | | | 2/1977 |
| EP | 0343103 | Y | | 11/1989 |
| EP | 0611610 | Y | | 8/1994 |
| EP | 0686702 | | | 12/1995 |
| EP | 1108485 | | | 6/2001 |
| EP | 1243343 | Y | | 9/2002 |
| EP | 1356868 | Y | | 10/2003 |
| EP | 1366838 | Y | | 12/2003 |
| EP | 2010347 | B1 | | 1/2009 |
| JP | 61074763 | | | 4/1986 |
| JP | 04080645 | | | 7/1992 |
| JP | 08267205 | A | * | 10/1996 |
| JP | 9057412 | | | 3/1997 |
| JP | 9141408 | | | 6/1997 |
| JP | 9225607 | | | 9/1997 |
| JP | 63112058 | Y | | 5/1998 |
| JP | 2001232451 | | | 8/2001 |
| JP | 2002079356 | | | 3/2002 |
| JP | 2003275852 | | | 9/2003 |
| JP | 2004167521 | | | 6/2004 |
| JP | 2005279691 | | | 10/2005 |
| WO | 0191943 | | | 12/2001 |
| WO | 03013763 | Y | | 2/2003 |
| WO | 2004048016 | | | 6/2004 |
| WO | 2007121804 | | | 11/2007 |

OTHER PUBLICATIONS

JPO machine translation of JP 2003-275852, Sep. 30, 2003.*

Thermal and Mechanical Effect of High Pressure Spraying of Hot Surface; Miroslav Raudensky, Oct. 1999.

Scale Formation and Descaling in Continuous Casting and Hot Rolling; M.M. Wolf, 2000.

JPO Machine Translation JP2003-275852, Sep. 30, 2003.

* cited by examiner

METHOD AND APPARATUS FOR CONTINUOUS CASTING

CROSS-REFERENCE TO RELATED APPLICATIONS

The present application is a Divisional Application of U.S. patent application Ser. No. 12/087,305, filed Sep. 2, 2008, which is a 371 of International application PCT/EP2006/012560, filed Dec. 28, 2006, which claims priority of DE 10 2006 001 464.2, filed Jan. 11, 2006, and DE 2006 056 683.1, filed Nov. 30, 2006, the priority of these applications is hereby claimed and these applications are incorporated herein by reference.

BACKGROUND OF THE INVENTION

The invention concerns a method for the continuous casting of slabs, thin slabs, blooms, preliminary sections, rounds, tubular sections, billets, and the like from molten metal in a continuous casting plant, where metal flows vertically downward from a mold, where the metal strip is then guided vertically downward along a vertical strand guide, cooling as it moves, where the metal strip is then deflected from the vertical direction to the horizontal direction, and where in the terminal area of the deflection of the metal strip into the horizontal direction or after the deflection into the horizontal direction, a mechanical deformation of the metal strip is carried out. The invention also concerns a continuous casting installation, especially for carrying out this method.

A continuous casting method of this general type is disclosed, for example, by EP 1 108 485 A1 and WO 2004/048016 A2. In this method, molten metal, especially steel, is discharged vertically downward from a mold. As it flows down, it solidifies and forms a metal strip, which is gradually deflected or turned from the vertical direction to the horizontal direction. Directly below the mold, there is a vertical strand guide, which initially guides the still very hot metal strip vertically downward. The metal strip is then gradually turned into the horizontal direction by suitable rolls or rollers. Once the strip is moving horizontally, it is usually subjected to a straightening process, i.e., the metal strip passes through a straightener, in which it is mechanically deformed.

Similar solutions are described in JP 63 112058 A, WO 03/013763 A, EP 0 611 610 A1, DE 22 08 928 A1, DE 24 35 495 A1, DE 25 07 971 A1, EP 0 343 103 A1, EP 1 243 343 B1, EP 1 356 868 B1, and EP 1 366 838 A.

Great importance is attached to the cooling of the metal strip after it emerges from the mold. In this connection, EP 1 108 485 A1 proposes a device for cooling the cast strand in a cooling zone, in which the strand is supported and guided by pairs of rollers arranged one above the other transversely to the axis of the strand along the strand discharge direction, with the strand being further cooled by the discharge of coolant. To achieve efficient cooling of the metal strip, the proposed device comprises a cooling element that conveys coolant and is arranged between two rollers positioned one above the other. The cooling element extends along the longitudinal axis of the rollers and is designed in such a way that gaps are formed between the given cooling element and the roller and between the cooling element and the strand. Each cooling element is provided with at least one channel that conveys coolant and opens into a gap.

To achieve optimum temperature management of the cast metal strip, WO 2004/048016 A2 proposes that a dynamic spraying system in the form of the distribution of the amount of water and the pressure distribution or pulse distribution over the width and length of the strand is functionally controlled by means of the runout temperature, which is determined by monitoring the surface temperature at the end of the metallurgical length of the cast strand, so as to obtain a temperature curve calculated for the strand length and the strand width.

Many other solutions to the problem likewise deal with the question of how a metal strand can be cooled efficiently and in a way that is suitable from the standpoint of the process engineering that is involved. In this regard, reference is made to JP 61074763 A, JP 9057412, EP 0 650 790 B1, U.S. Pat. No. 6,374,901 B1, US 2002/0129921 A1, EP 0 686 702 B1, WO 01/91943 A1, JP 2004167521, and JP 2002079356.

It has been found that in addition to cooling of the cast metal strand that is efficient and suitable from the standpoint of the process engineering, high-temperature oxidation or scaling of the metal strip plays a considerable role. Due to the very high temperature of the metal strip immediately after the metal has been discharged from the mold, the strip is subject to an intense scaling effect, which adversely affects especially the downstream process steps. Therefore, it is important to try to keep the degree of scaling as low as possible.

SUMMARY OF THE INVENTION

The objective of the invention is to further develop a method of the aforementioned type and a corresponding installation in such a way that it is possible not only to achieve optimum cooling of the metal strip but also to minimize scaling of the metal strip.

In accordance with the invention, the objective with respect to a method is achieved by cooling the metal strip at a heat-transfer coefficient of 3,000 to 10,000 W/($m^2$ K) in a first section downstream of the mold and upstream of the mechanical deformation of the metal strip with respect to the direction of conveyance of the metal strip, where in a second section, downstream of the cooling with respect to the direction of conveyance of the metal strip, the surface of the metal strip is heated to a temperature above Ac3 or Ar3 by heat equalization in the metal strip with or without reduced cooling of the surface of the metal strip, after which the mechanical deformation is carried out in a third section.

In accordance with a preferred proposal of the invention, if the surfaces of the metal strip are cleaned before they are acted upon by the cooling medium, the effect of the subsequent cooling is further improved. The cleaning can consist of descaling, for example, in such a way that the cooling devices (nozzles, nozzle bars, or the like) that lie opposite each other in the direction of withdrawal of the strand or metal strip, are reached first by the metal strip/strand and are thus the frontmost or uppermost cooling devices apply the cooling medium under high pressure to produce descaling.

The mechanical deformation in the third section can be a process for straightening the metal strip or it can include a straightening process. Alternatively or additionally, it is possible for the mechanical deformation in the third section to be a process for rolling the metal strip or it can include a rolling process.

The cooling in the first section can be limited to the region of the vertical strand guide and in this case is designed as intensive cooling. In this connection, it should be noted that the term "vertical strand guide" is also meant to convey the idea that the metal strip is guided largely in the vertical direction.

The cooling in the first section can also be carried out intermittently, with the metal strip or strand being cooled alternately intensely and weakly, e.g., by variation of the coolant application density [L/min·m$^2$] and/or by adjustment of different distances between the cooling devices and the metal strip.

The proposed continuous casting installation for the continuous casting of slabs, thin slabs, blooms, preliminary sections, rounds, tubular sections, billets, and the like from molten metal, with a mold, from which the metal is discharge vertically downward, a vertical strand guide arranged below the mold, and means for deflecting the metal strip from the vertical direction into the horizontal direction, where mechanical means for deforming the metal strip are located in the terminal area of the deflection of the strip into the horizontal direction or after the deflection into the horizontal direction, is characterized, in accordance with the invention, by the fact that the vertical strand guide has a number of rollers arranged on both sides of the metal strip in the direction of conveyance of the metal strip, where first cooling devices, with which a cooling fluid can be applied to the surface of the metal strip, are arranged in the area of the rollers, where the cooling devices are mounted in such a way that they can be moved in the vertical and/or horizontal direction, and where additional, second, stationary cooling devices are installed in the area of the vertical strand guide.

Alternatively or additionally, it is advantageous for the cooling devices to be capable of oscillating.

The first and/or the second cooling devices can have a housing, from which the cooling fluid is applied by at least one nozzle. The cooling fluid can be applied from the housing by two nozzles or rows of nozzles.

In accordance with the proposal of the invention, cooling of well-defined intensity is carried out in the area of the secondary cooling of the metal strip. The cooling intensity is selected in such a way that, on the one hand, a qualitatively high-grade metal strip can be produced with the desired microstructure and microstructural composition, but, on the other hand, the degree of scaling of the strip surface can be kept to a minimum.

The proposal of the invention also reduces the concentration of undesired accompanying phenomena on the surface of the strip.

The proposed procedure causes thermal shock that is intense enough that oxide layers present on the surface of the metal strip are detached and washed away. This results in a cleaned strand surface, which is advantageous for uniform cooling of the metal strip as well as for possible heating in the pusher furnace.

Another advantage of the proposed method is that it reduces the risk of precipitation or hot shortness. Due to the lowering of the surface temperature that is necessary for the thermal shock—the surface temperature should not fall below the martensite beginning temperature—a transformation of the austenite in the metal strip to ferrite occurs, accompanied by grain refinement. During the subsequent reheating, the large temperature gradient between the surface and core of the metal strip causes a retransformation of the fine ferrite into austenite with small grains. During these transformations, the aluminum nitrides (AlN) or other precipitates are overgrown, and at the grain boundaries the percentage of aluminum nitrides is smaller than with the large austenite grain before the transformation. Therefore, the finer microstructure is less susceptible to cracking.

The region for intensive cooling is provided in the strand guide below the mold, so that the reheating can be carried out as early as possible. The ferrite transformation and the subsequent transformation to austenite should occur before the mechanical loading of the surface of the strand, for example, in the bending drivers. This measure reduces the risk of cracking that exists due to the temperature reduction of the strand due to thermal shock. In one embodiment of the method, the aforesaid (intensive) cooling covers about one fourth to one third of the (curved) path from the mold to the mechanical deformation, which is followed by about three fourths or two thirds of this path, in which cooling is no longer carried out or is carried out at a reduced level.

The intensive cooling system provided in accordance with the invention can be arranged between the strand guide rollers and can extend over a more or less long region of the strand guide, depending on the desired cooling effect. As has already been noted, it may also be advantageous to apply the intensive cooling intermittently to avoid excessive undercooling of the surface, especially when materials that are susceptible to cracking are involved.

This can also reduce hot shortness, i.e., cracking at the surface of the slab, which can occur especially as a result of a high copper content of the material. This is relevant especially when the feedstock consists of scrap, which sometimes has a sufficiently high copper content for this problem to occur.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
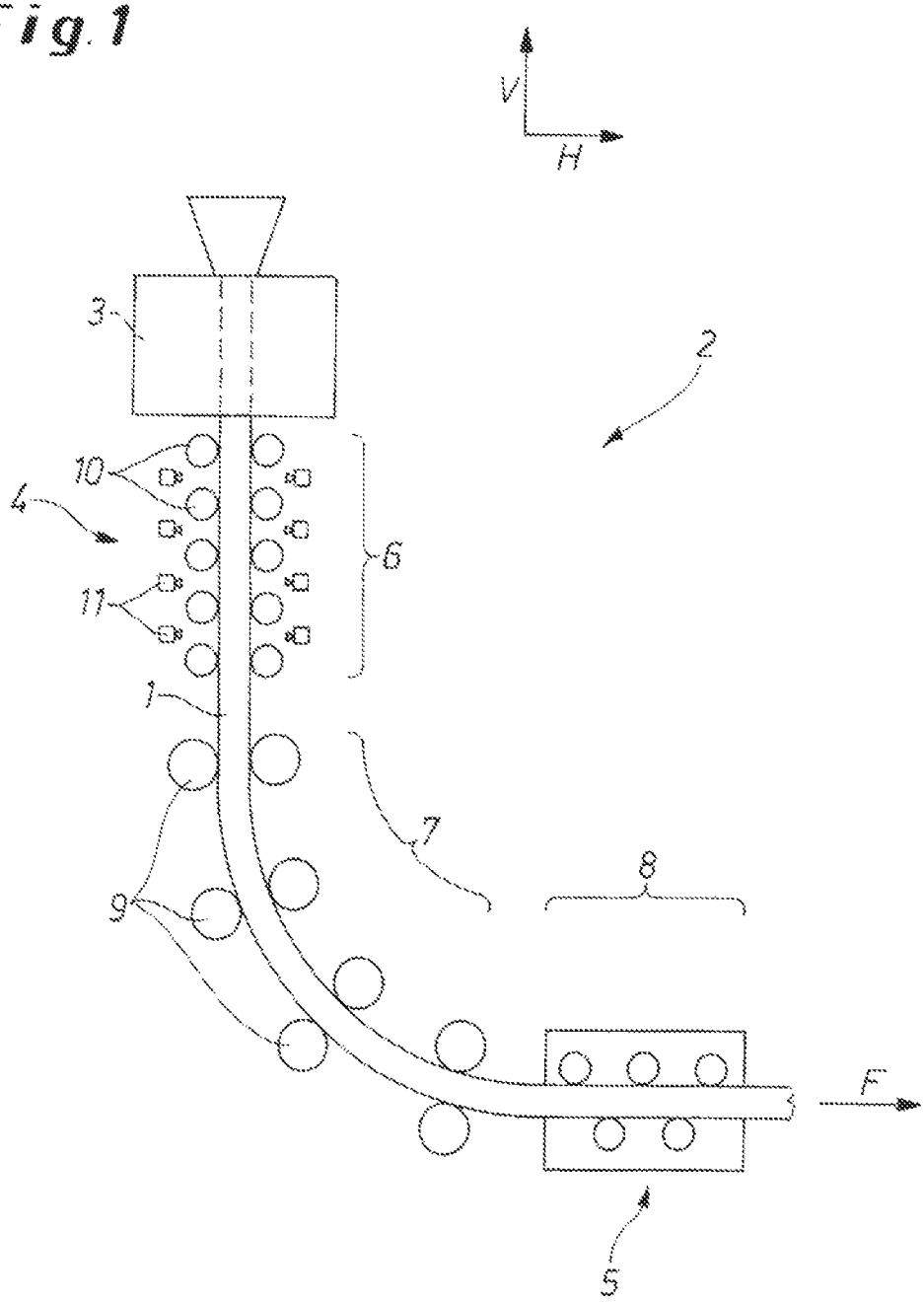
FIG. 1 is a schematic side view of a continuous casting installation that shows some of the components of the installation.

A continuous casting installation 2 is shown schematically in FIG. 1. Liquid metal material flows vertically downward as a strand or metal strip 1 from a mold 3 in direction of conveyance F and is gradually deflected from the vertical V into the horizontal H along a curved casting segment. Directly below the mold 3, there is a vertical strand guide 4, which has a number of rollers 10, which guide the metal strip 1 downward. A number of rollers 9 act as means for bending the metal strip 1 from the vertical V to the horizontal H. After it has been deflected in this way, the metal strip 1 enters means 5 for mechanical deformation. In the present case, this involves a straightening driver, which subjects the metal strip 1 to a straightening process by mechanical deformation. A rolling process can also be provided, usually after the straightening process.

The region of the metal strip from its discharge from the mold 3 to the mechanical deformation is divided into three sections. Intensive cooling of the hot metal strip 1 occurs in the first section 6. In a second section 7, practically no further cooling is carried out, and the heat present in the metal strip 1 reheats the cooled surface of the metal strip 1. Finally, especially in the third section 8, but possibly already in the second section 7, the mechanical deformation is then carried out. The specific embodiment shows that the first section 6 is further divided into subsections. This provides a simple means of intermittent cooling in the first section 6, namely, intensive cooling in a first subsection and weaker or reduced cooling or no cooling at all in the at least one additional subsection, which can be followed by another intensive cooling section, etc.

Figure 2:
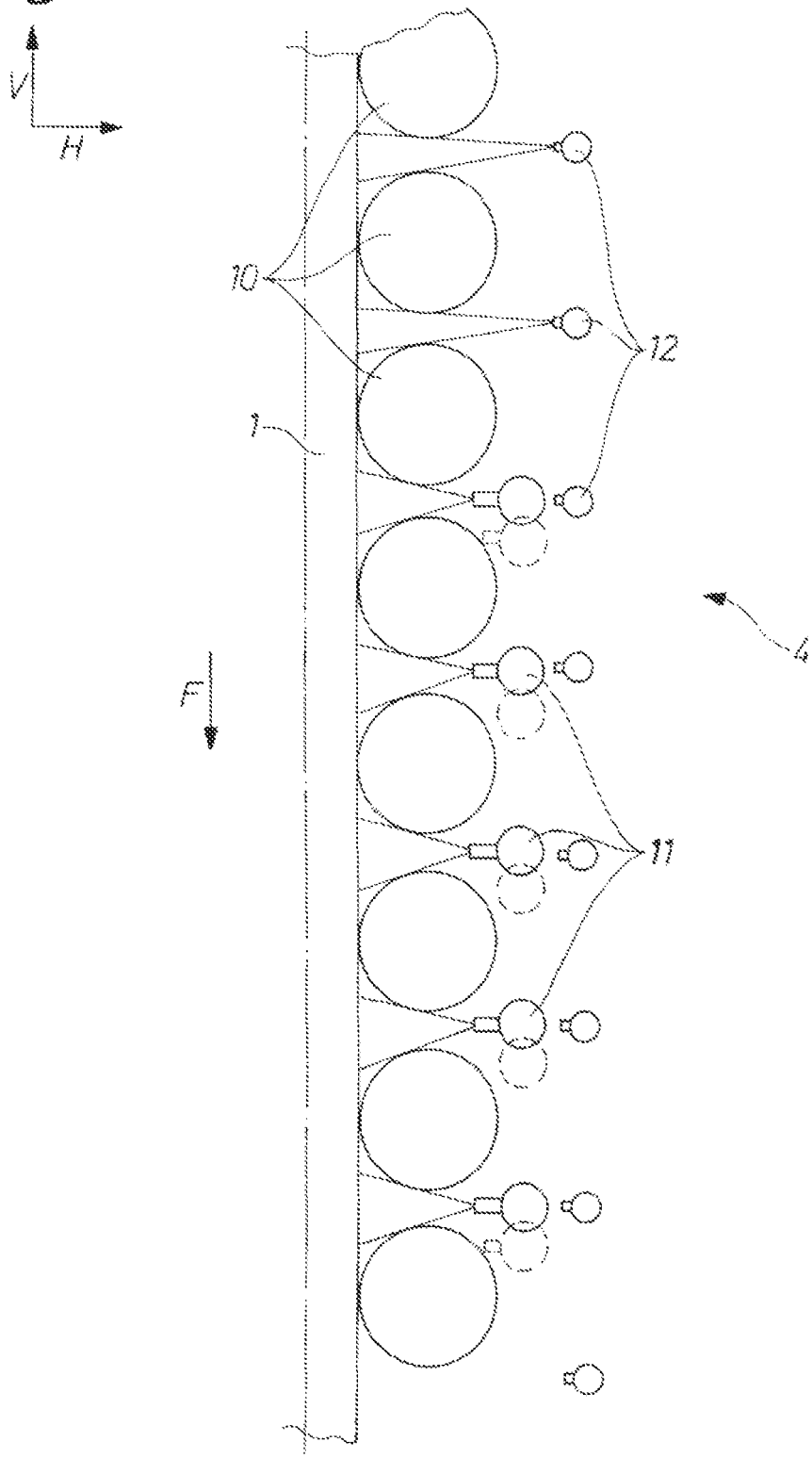
FIG. 2 shows an enlarged section of FIG. 1, namely, the right branch of the vertical strand guide with first and second cooling devices.

The cooling of the metal strip 1 is carried out with first cooling devices 11 and second cooling devices 12, as is shown best in FIG. 2. The cooling devices 11 operate intensively with a high cooling capacity. The second cooling devices 12 are standard cooling devices which in themselves are already well known and are used in previously known continuous casting installations. The cooling devices 11 are configured in such a way that the metal strip 1 is cooled at a heat-transfer coefficient of 2,500 to 20,000 W/($m^2$ K) in the first section 6, especially in the subsection which immediately follows the mold 3 and whose uppermost or frontmost cooling devices in the withdrawal direction F can be switched to high pressure to descale and thus clean the surfaces of the metal strip 1. Most of the cooling is thus effected by the first cooling devices 11.

The following should be noted about the aforementioned heat-transfer coefficient: The heat-transfer coefficient (symbol $\alpha$) is a proportionality factor that determines the intensity of heat transfer at a surface. The heat-transfer coefficient describes the ability of a gas or liquid to carry away energy from the surface of a substance or to add energy to the surface of a substance. It depends, among other factors, on the specific heat, the density, and the coefficient of thermal conduction of the medium carrying away the heat and the medium supplying the heat. The coefficient of thermal conduction is usually computed via the temperature difference of the media that are involved. It is immediately apparent from the specified influencing variables that the designing of the intensity of the cooling has direct effects on the heat-transfer coefficient. The cooling capacity can be influenced, for example, by varying the horizontal distance between the cooling devices 11 and 12 and the metal strip 1, i.e., the cooling capacity decreases with increasing distance.

After the cooling in section 6, the surface of the metal strip 1 is heated to a temperature above Ac3 or Ar3 by heat equalization in the metal strip 1 without further cooling of the surface of the metal strip 1. It is only then that mechanical deformation 5 takes place in sections 7 (by bending) and 8, above all, by the straightening operation in section 8.

The aforementioned cooling devices 11 are not needed for every application. Therefore, as FIG. 2 shows, they can be vertically displaced by suitable displacement mechanisms (not shown). The cooling devices 11 are shown in their active positions with solid lines, with the discharged cooling water following the path indicated in the drawing.

If intensive cooling is not required, the cooling devices 11 can be moved vertically into the positions indicated with broken lines, so that conventional, lesser, i.e., less intensive, cooling is effected by the cooling devices 12.

Other measures for controlling (reducing or increasing) the cooling capacity consist in variation of the distance between the cooling devices 11, 12 and the metal strip 1 by horizontal displacement of the cooling devices 11, 12 and/or in oscillating movement of the cooling devices 11, 12.

The drawings do not show suitable conduit systems with valves, by which the flow of cooling water required in each case can be adjusted or switched.

Figure 3:
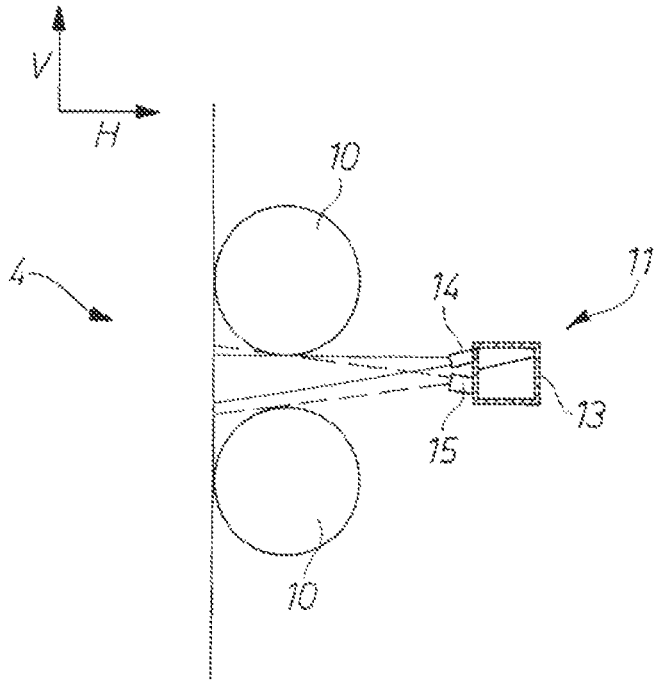
FIG. 3 shows an enlarged section of FIG. 2 with two rollers and a cooling device arranged between them.
Figure 4:
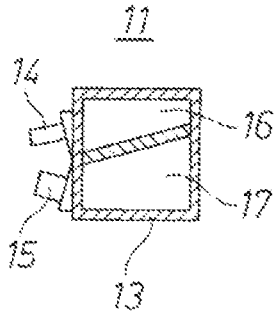
FIG. 4 shows detail of the cooling device according to FIG. 3.

A variant of the design of the first cooling devices 11 is shown in detail in FIGS. 3 and 4. The cooling devices 11 have a housing 13, on whose side facing the metal strip 1 two nozzles 14 and 15 or rows of nozzles extending perpendicularly to the plane of the drawing across the metal strip 1 are arranged. The inside of the housing 13 has two corresponding chambers 16, 17, each of which has a fluid connection with a water supply line. The nozzles 14 and 15 have different designs, so that water jets of different strengths can be directed at the metal strip, depending on the technological necessity of realizing a surface of the metal strip 1 that is as free of scale as possible and thus clean.

The nozzles can also be designed as a nozzle bar, i.e., as a bar that extends across the width of the metal strip 1 and directs cooling water at the surface of the strip from a number of nozzle orifices.

The proposed device for intensive cooling thus has a housing that can be pushed between the continuous casting guide rollers 10 with little distance between it and the rollers and thus forms a cooling channel. The housing 13 can be protected by a guard plate (not shown) from being destroyed in the event of a possible breakout, so that it can be used again if a breakout occurs. The cooling effect can be controlled by varying the distance between the surface of the strand and the housing 13. The design of the housing and design of the nozzles 14, 15 are other possible means of controlling the cooling effect.

For example, it is possible to divide the nozzles into several groups and to provide each of the individual groups of nozzles with its own water supply. The cooling effect can then be varied by turning individual groups of nozzles on or off and/or by varying the volume flow rate or the fluid pressure. In the case of standard cooling, i.e., if steels for which intensive cooling is not suitable are being processed, a smaller number of nozzles can be turned on. Another possibility is to move or swing the intensive cooling device out of the spraying zone of the standard cooling system.

Undercooling of the edge region of the metal strip can also be avoided by turning certain groups of nozzles on or off.

Spray nozzles can also be used for the intensive cooling. They should be distributed close to each other over the width of the metal strip in order to realize the necessary cooling and the associated grain refinement and descaling effect. By turning these groups of nozzles on and off, it is again possible to avoid undercooling of the edges. For a casting operation in which intensive cooling is not advantageous, the nozzles can be deactivated, swung away or moved away, or the volume flow rate of the cooling medium (water) can be reduced to ensure that standard cooling is realized.

It can also be provided that besides the existing secondary cooling system, an additional cooling system can be used that consists of several spray bars, each with a plurality of spray nozzles and a separate water supply. The additional spray bars are turned on only when they are needed. By turning these groups of nozzles on and off, it is again possible to avoid undercooling of the edges.

In the prior art, special descaling nozzles are known which attain heat-transfer coefficients of more than 20,000 W/($m^2$ K). Nozzles of this type are not used or are not usable for the present invention due to their excessively intense cooling effect and the associated low temperature of the surface of the metal strip.

The basic idea of the invention can thus be seen in the fact that intensive cooling is carried out in the region of secondary cooling, especially in thin slab installations, in order to achieve cleaning of the surface of the slab, where the intensive cooling begins shortly after the mold—as viewed in the direction of conveyance. However, the invention also provides that the cooling is ended sufficiently early that reheating above the temperature Ac3 or Ar3 can occur, before mechanical stresses arise, as is the case, for example, in the bending driver. The goal of this is that there be little or no precipitation at the grain boundaries.

The proposed device for intensive cooling has a significantly greater cooling effect than is otherwise the case in the secondary cooling system of a continuous casting installation. In previously known installations, the customary heat-transfer coefficients are 500 W/($m^2$ K) to 2,500 W/($m^2$ K). On the other hand, descaling systems are known in which a cooling unit is used that realizes heat-transfer coefficients of more than 20,000 W/($m^2$ K).

As has already been noted, the heat-transfer coefficients required in the present case depend on the material. They also depend on the casting speed. They are obtained from the maximum cooling rate at which martensite or bainite is still not formed. For low carbon steels, the cooling rate is about 2,500° C./min, which, at a casting speed of 5 m/min, corresponds to a heat-transfer coefficient of about 5,500 W/($m^2$K).

Rapid switching between standard and intensive cooling allows very flexible and individual use of the proposed continuous casting installation.

If the proposed systems are used with the described cooling nozzles, higher heat-transfer coefficients are realized with a relatively small amount of water than is the case in conventional spray cooling due to the high turbulence of the water that develops between the housing of the cooling devices and the metal strip.

The intensity of the cooling can be varied by the number of nozzles arranged side by side. Furthermore, it is also possible to use additional nozzle bars in conventional spray cooling systems.

The length of the intensive cooling—as viewed in the direction of conveyance F—is determined by the solidification microstructure up to 2 mm below the surface of the metal strip. In the case of dendritic solidification, the length of the intensive cooling zone is greater by a factor of 2 to 3 than the length in equiaxed solidification.

The heat-transfer coefficient is also determined by the design of the cooling devices, in the present case, especially the first cooling devices 11. The coefficient is systematically selected in the claimed zone, since the conditions for intensive cooling of the finished metal strip 1 are optimal here, and at the same time a largely scale-free strip surface can be produced.

While specific embodiments of the invention have been shown and described in detail to illustrate the inventive principles, it will be understood that the invention may be embodied otherwise without departing from such principles.

We claim:

1. A continuous casting installation for the continuous casting of slabs, thin slabs, blooms, preliminary sections, rounds, tubular sections or billets from molten metal, with a mold, from which the metal is discharged vertically downward, a vertical strand guide arranged below the mold, and means for deflecting the metal strip from the vertical direction into the horizontal direction, where mechanical means for deforming the metal strip are located in the terminal area of the deflection of the metal strip into the horizontal direction or after the deflection into the horizontal direction, wherein the vertical strand guide has a number of rollers arranged on both sides of the metal strip in the direction of conveyance of the metal strip, where first cooling devices, with which a cooling fluid can be applied to the surface of the metal strip, are arranged in the area of the rollers, where the first cooling devices are mounted in such a way that they can be moved in the vertical direction or in the vertical and horizontal direction, and where stationary second cooling devices are additionally installed in the area of the vertical strand guide, wherein the first cooling devices have a higher cooling capacity than the second cooling devices, wherein the first cooling devices are arranged downstream of at least one of the second cooling devices in the conveyance direction of the strip.

2. A continuous casting installation in accordance with claim 1, wherein the cooling devices are designed to oscillate.

3. A continuous casting installation in accordance with claim 1, and further comprising second cooling devices, wherein the first and/or the second cooling devices have a housing, from which the cooling fluid is discharged by at least one nozzle.

4. A continuous casting installation in accordance with claim 3, wherein the cooling fluid is discharged from the housing by two nozzles or rows of nozzles.

* * * * *